US005502846A

United States Patent [19]

Chelchowski et al.

[11] Patent Number: 5,502,846

[45] Date of Patent: Apr. 2, 1996

[54] FLUSH TANK MECHANISM

[75] Inventors: David Chelchowski, Largs Bay; Colin W. Wooldridge, Burton, both of Australia

[73] Assignee: Caroma Industries Limited, Brisbane, Australia

[21] Appl. No.: 269,612

[22] Filed: Jun. 30, 1994

Related U.S. Application Data

[63] Continuation of Ser. No. 36,068, Mar. 23, 1993, abandoned.

[30] Foreign Application Priority Data

Mar. 24, 1992 [AU] Australia ..... PL1494

[51] Int. Cl.[6] ..... E03D 1/14; E03D 1/35

[52] U.S. Cl. ..... 4/325; 4/391; 4/398; 4/410

[58] Field of Search ..... 4/325, 391, 398, 4/415, 324, 390, 395, 397, 410, 413, 414

[56] References Cited

U.S. PATENT DOCUMENTS

| | | | |
|---|---|---|---|
| 542,485 | 7/1895 | Menzies | 4/391 |
| 3,259,918 | 7/1966 | Walker, Sr. et al. | 4/415 |
| 3,732,577 | 5/1973 | Moon | 4/415 |
| 3,811,134 | 5/1974 | Throckmorton et al. | 4/391 X |
| 4,080,667 | 3/1978 | Walsh et al. | 4/415 |
| 4,171,547 | 10/1979 | Raz | 4/326 |
| 4,250,579 | 2/1981 | Moon | 4/415 |
| 4,882,793 | 11/1989 | Thompson | 4/324 |
| 4,918,769 | 4/1990 | Gandini | 4/661 |
| 5,003,644 | 4/1991 | Huang | 4/324 |

FOREIGN PATENT DOCUMENTS

| | | | |
|---|---|---|---|
| 597438 | 4/1988 | Australia . | |
| 0609998 | 12/1989 | Australia | 4/391 |
| 2640023 | 6/1990 | France | 4/415 |
| 3331047 | 6/1985 | Germany . | |
| 2301932 | 4/1995 | Germany . | |
| 47352 | 6/1979 | Israel . | |
| 98442 | 1/1993 | Israel . | |
| 98692/2 | 10/1993 | Israel . | |

*Primary Examiner*—Robert M. Fetsuga

*Attorney, Agent, or Firm*—Merchant, Gould, Smith, Edell, Welter & Schmidt

[57] ABSTRACT

The present invention discloses an operating mechanism for a cistern (1) or flush tank which is able to be used for a wide variety of cisterns, irrespective of their volume to depth profile. The preferred mechanism takes the form of a generally cup-shaped weir (22) which surrounds the flush valve (18) and from which a support frame (7) extends. The height of the rim of the weir is able to be selected or adjusted, for example by the use of a number of rupturable panels (24) located in the walls of the weir (22). A mechanism (26,27) to adjust for height variations between the flush actuators (14) and the flush operating mechanism (15) is also disclosed.

9 Claims, 3 Drawing Sheets

FLUSH TANK MECHANISM

Figure 1:
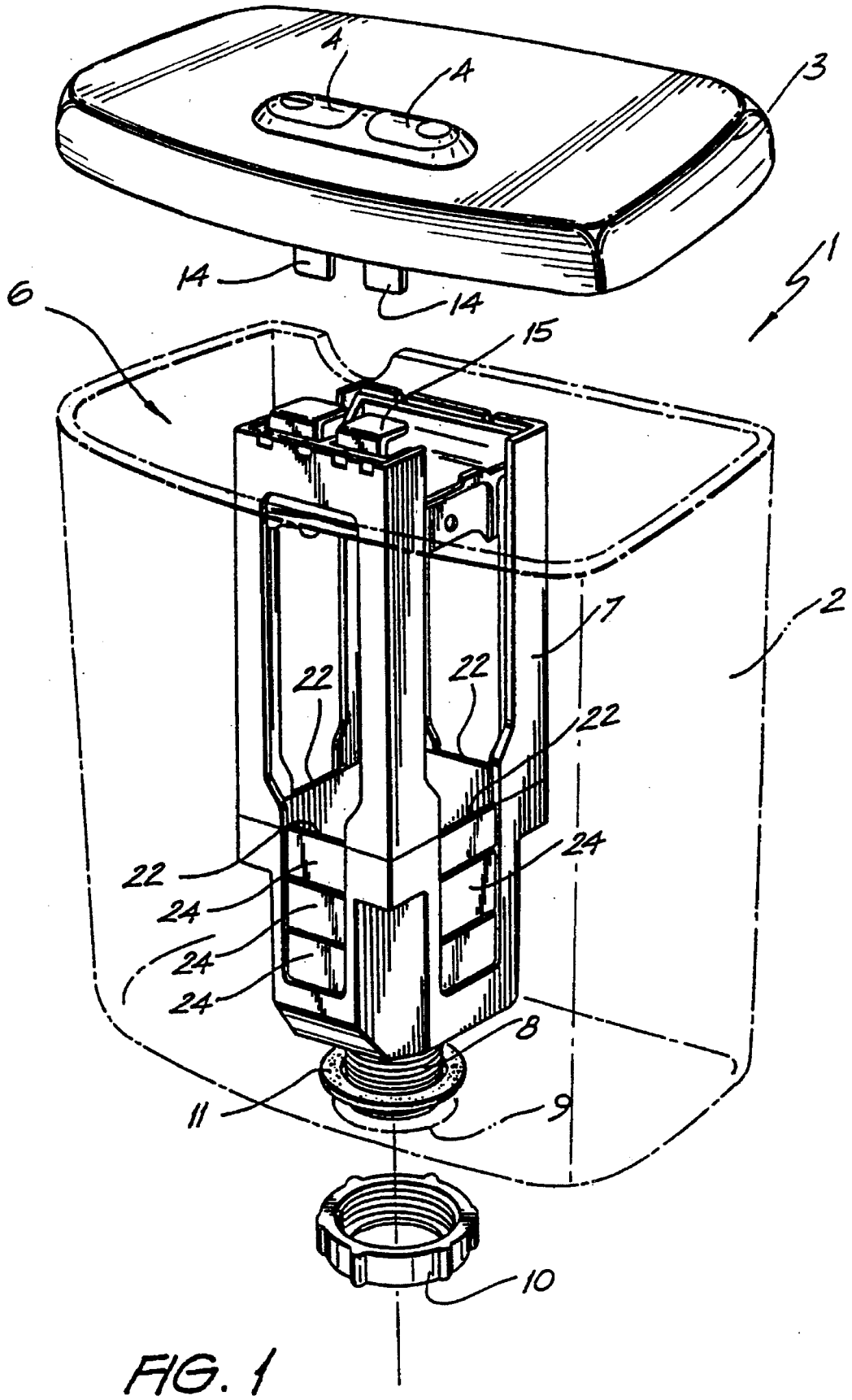

This is a continuation of application Ser. No. 08/036,068, filed Mar. 23, 1993, which was abandoned upon the filing thereof.

The present invention relates to cisterns or flush tanks and, in particular, to a cistern mechanism which is able to be used with a wide variety of cisterns.

Most cistern manufacturers have a wide variety of cisterns which are intended to be used with different types of lavatory pans. Some cisterns are moulded from plastics material whilst others are fabricated from vitreous china. In particular, with vitreous china cisterns it is difficult to secure a cistern mechanism to the internal surface of the cistern. For this reason it is desirable that the cistern mechanism be able to be mounted by means of a connection with the flush pipe or flush aperture of a cistern.

Furthermore, it is also desirable for reasons of reduction of stock volumes, reduction in stock lines, and economies of scale to be achieved from large volume production, if a single cistern mechanism can be used throughout the entire range of cisterns. In this connection it will be appreciated that because different models of cisterns have different shapes in order to achieve different appearances, such cisterns have different volume to depth profiles. The volume to depth profile of a cistern is the way in which the available volume of water contained within the interior of the cistern varies with increasing depth above the minimum water height within the cistern. Clearly a cistern with a large internal cross sectional area will have a greater volume to depth profile than a relatively slim cistern of relatively small cross sectional area.

It is the object of the present invention to provide a cistern mechanism which can cater for a wide variety of cisterns notwithstanding the different volume to depth profile of such cisterns.

According to one aspect of the present invention there is disclosed a cistern mechanism for a wide variety of cisterns each of which has a different volume to depth profile, said mechanism comprising a frame mountable within the cistern by connection with the flush pipe and/or flush aperture, a flush valve mounted in said frame, a weir surrounding said valve and extending above said valve to a predetermined height, a flush valve lifting mechanism mounted on said frame above said flush valve, and means to select the height of at least a portion of said weir relative to said flush valve to set said predetermined height.

It is also desirable in catering for the different variety of cisterns if the mechanical linkage between the manually operable flush actuator and the flush valve lifting mechanism can be adjusted in order to accommodate the different dimensions inherent in different styles of cisterns. Also vitreous china cisterns of the same model or style may vary by as much as 10% in shrinkage from batch to batch. It is therefore a preferred feature of the present invention to provide a cistern adjustment mechanism which addresses these problems.

According to a second, and preferred, aspect of the present invention there is disclosed a cistern adjustment mechanism for a linkage interconnecting a manually operable flush actuator and a flush valve lifting mechanism, said adjustment mechanism comprising a screw adjustment interconnecting that portion of the flush valve lifting mechanism which comes into contact with said manually operable flush actuator and the remainder of said flush valve lifting mechanism, whereby any difference in spacing between said manually operable flush actuator and said flush valve lifting mechanism after installation of the flush valve lifting mechanism within the cistern, can be compensated for by adjustment of said screw adjustment.

Figure 2:
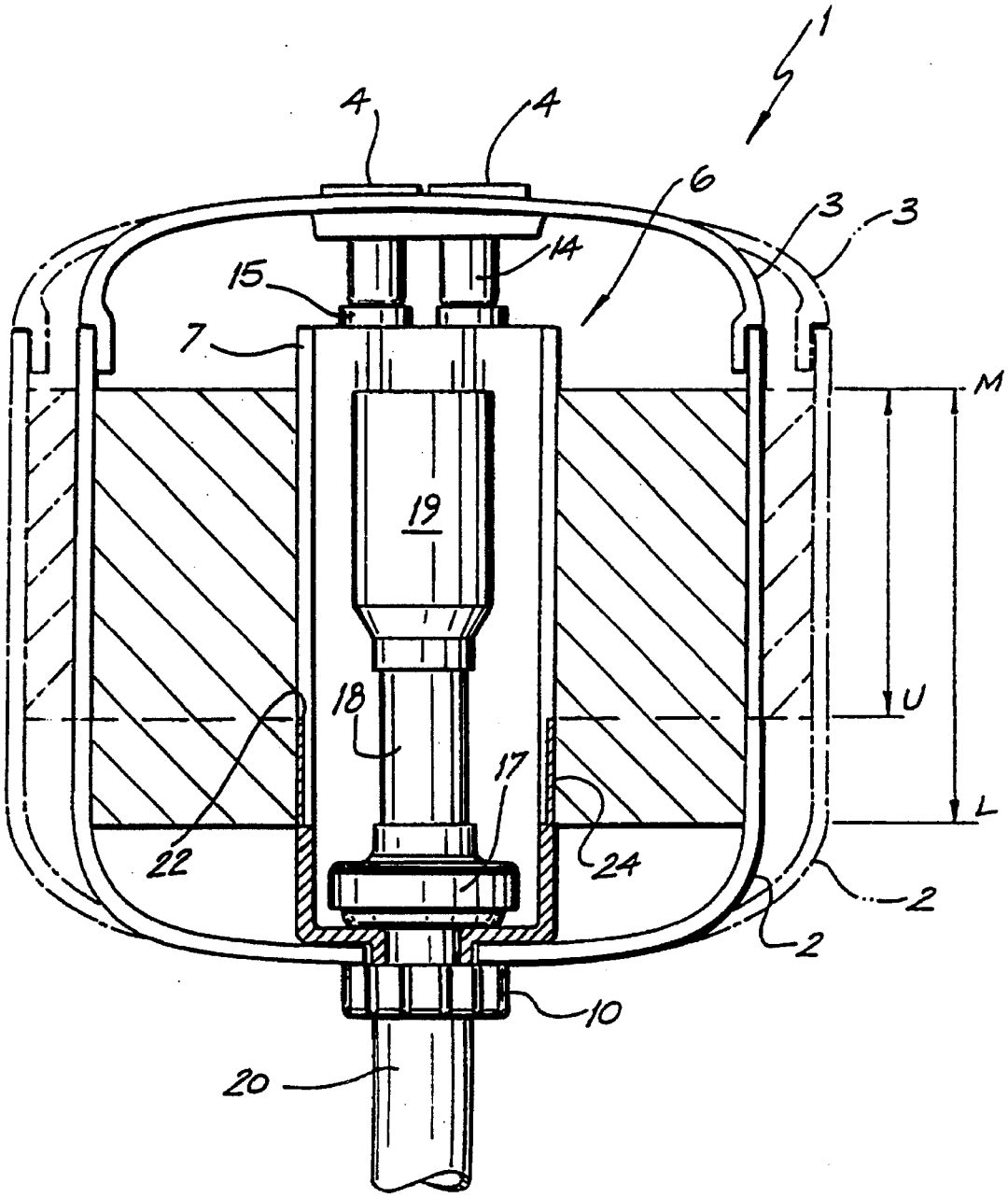
Figure 3:
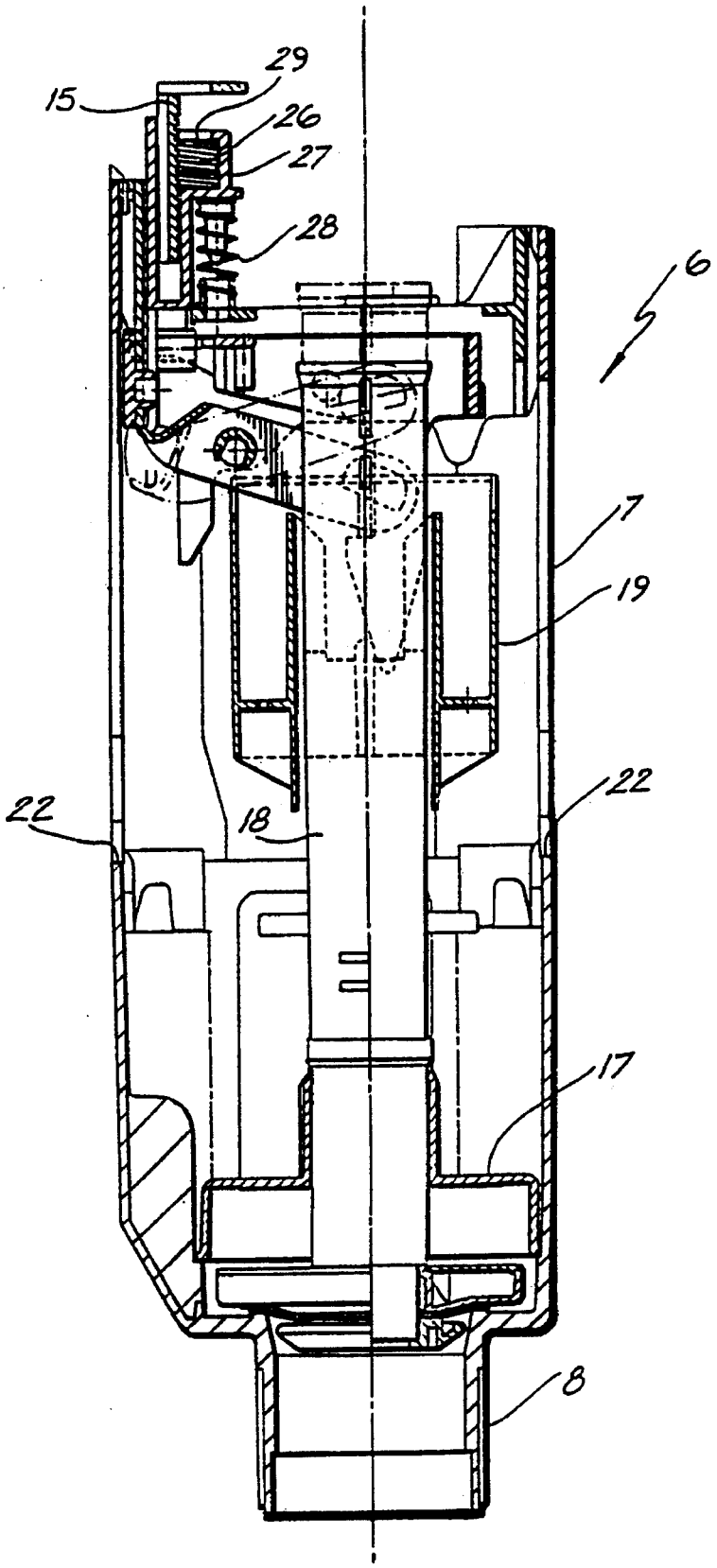

One embodiment of the present invention will now be described with reference to the drawings in which:

FIG. 1 is an exploded perspective view of a cistern incorporating the cistern mechanism of the preferred embodiment, FIG. 2 is a side-to-side vertical cross-sectional view of the cistern mechanism of FIG. 1 illustrating different water heights for different types of cisterns, and FIG. 3 is a front to rear cross-sectional view through the cistern mechanism of FIGS. 1 and 2.

As seen in FIG. 1, a cistern 1 takes the form of a cistern body 2 and a lid 3. The lid 3 is provided with two push button actuators 4, one of which is intended to activate a reduced volume flush whilst the other of which activates a full volume flush. Located within the cistern body 2 is a self contained cistern mechanism 6 having a generally rectangular frame 7 and a threaded spigot 8 which passes through a central opening 9 in the base of the cistern body 2. The frame 7 is able to be secure within the cistern body by means of engagement of a threaded nut 10 with the spigot 8. A sealing washer 11 completes the arrangement and forms a water tight seal between the exterior of the frame 7 and the cistern body 2. The spigot 8 further connects with a flush pipe 20 (FIG. 2) in conventional fashion.

It will be seen that the above described arrangement has the advantage that the entire cistern mechanism 6 is able to be mounted within the interior of the cistern 1 without any engagement with the interior walls of the cistern.

Depending from each of the push button actuators 4 is a corresponding push rod 14 the lower end of which, when the cistern lid 3 is in position, abuts the upper surface of a corresponding L-shaped lift actuator 15. As will be described in more detail in relation to FIG. 3, each of the lift actuators 15 is coupled to a flush valve lifting mechanism.

Located at the lower end of the frame 7, and illustrated in FIGS. 2 and 3, is a flush valve 17 which is connected to the lower end of an upstanding stem 18 on which a float 19 is slidably mounted. The stem 18 is hollow, and an upper end of which constitutes an overflow arrangement.

In order to flush the cistern, the stem 18 is raised thereby unseating the sealing membrane 31, opening the flush valve 17 and allowing water stored within the cistern to pass through the flush valve 17 and into the flush pipe 20 (FIG. 2). For a reduced volume flush, the float 19 is used to knock the stem 18 down, the mass of the float 19 being greater than the buoyant force of the annular disc float 30, thereby prematurely ending the flushing action. For a full volume flush the stem 18 drops until the upwardly directed buoyant force of the disc float 30 reduces to zero as a result of all the flushing water emptying from the flush tank 7, causing reseating of the sealing membrane 31.

As best seen in both FIGS. 1 and 2, the flush valve 17 is surrounded on all four sides by a cup-shaped weir 22. For a reduced volume flush, the flushing action is brought to a close well before the level of water in the cistern drops to the height of the weir 22. However, for a full volume flush, the flushing action is brought to a close when the water level within the cistern drops to the height of the weir.

Referring now to FIG. 2, it will be appreciated that the maximum level of water within the cistern is determined by the inlet arrangements. A conventional float arm (not illustrated) is used to control the maximum height of water within the cistern. In particular, it must be below any overflow arrangement, typically the upper end of the hollow stem 18. Furthermore, for arrangements in which a cistern and lavatory pan are close coupled, the static head of the water within the cistern must not be unnecessarily reduced. For these reasons, within limits, the maximum height of water within the cistern may be regarded as being substantially fixed.

In recent times, in order to conserve water and thereby avoid the need for additional capital expenditure on dams, water supply authorities in many jurisdictions have begun to specify a maximum volume of water permitted in a flush, as well as the universal minimum permissible volume regarded as necessary to achieve a satisfactory flush of the lavatory pan and transport of the contents thereof along branch sewerage lines. It will be appreciated from FIG. 2, however, that different sizes and shapes of cisterns, because of their differing volume to depth profiles, require the water level to drop to different heights in order to flush the same volume of water.

In FIG. 2 the level M represents the maximum water height within a cistern. The level U represents the upper limit for the lowest level of water within the cistern indicated by dotted lines having a large cross sectional area in FIG. 2, whilst the level L represents the lower limit for the lowest level of water for the cistern having a smaller cross sectional area and illustrated by solid lines in FIG. 2.

In order to have a single cistern mechanism able to operate at a set full-flush volume with both cisterns, it is necessary to arrange for the full volume flush for the larger cistern to stop at level U whilst for the smaller cistern it is necessary that the full volume flush continue until the level L is reached. In accordance with the preferred embodiment this change in cessation level is accommodated by means of the weir 22.

As seen in both FIGS. 1 and 2, each of the four walls of the weir 22 is provided with a number (preferably three) of panels 24 which are of reduced thickness. Therefore if the frame 7 is to be used with the larger cistern (illustrated by broken lines in FIG. 2) then the weir 22 is used as illustrated in FIG. 1 and the cessation level for flushing for a full volume flush is the level U illustrated in FIG. 2. However, if the frame 7 is to be used with the smaller cross sectional area cistern illustrated by full lines in FIG. 2, then all the panels 24 of reduced thickness are removed by being broken away. Under these circumstances the full volume flush continues until the cessation level L is reached. In this way the desired maximum flush volume is reached but not exceeded with the cistern of smaller cross sectional area. Clearly, if a cistern having a volume to depth profile which dictates a cessation level somewhere between the levels U and L of FIG. 2 is required, then only one or two of the panels 24 is/are removed. If necessary, a portion of a panel 24 can be removed. Similarly, each wall of the weir need not be of the same height and, say, one of two of the walls can be lower.

The above described arrangement enables the flush cessation level to be adjusted within relatively wide limits. The levels for different types of cisterns can be easily indicated by horizontal lines (not illustrated) moulded across the panels 24. This enables the cistern mechanism to be retrofitted to existing cisterns if required. Alternatively, during the manufacture of the cistern mechanism, an insert (not illustrated) can be placed in the mould in known fashion so as to alter the height of the weir 22 relative to the threaded spigot 8. Either of these two stratagems constitutes a means to adjust or select the height of at least a portion of the weir relative to the flush valve.

Turning now to FIG. 3, the flush valve lifting mechanism illustrated therein is substantially conventional, being illustrated in more detail in applicant's U.S. Pat. No. 4,882,793, the disclosure of which is hereby incorporated by cross reference.

As seen in FIG. 3, one, interior, surface of each lift actuator 15 is provided with a threaded profile which is engaged with a grub screw 26 rotatably mounted in an internally threaded housing 27 which is itself movable relative to the frame 7 and biased into its uppermost, rest, position illustrated by means of a spring 28.

It will be apparent to those skilled in the art that turning the grub screw 26 by means of a slot 29 in its upper end, enables the rest position of the corresponding lift actuator 15 to be adjusted relative to the frame 7. As a consequence, any variation in the dome height of the cistern lid 3, for example, can be accommodated in order to ensure that the lower end of the push rods 14 in their rest position abut against the upper surface of lift actuators 15 in their rest position. This adjustment mechanism ensures that variations between different models of cisterns can be easily accommodated thereby enabling the cistern mechanism to be used throughout a wide range of cisterns and, in particular, throughout the entire range of cisterns produced by a given cistern manufacturer.

The foregoing describes only one embodiment of the present invention and modifications, obvious to those skilled in the art, can be made thereto without departing from the scope of the present invention.

What we claim is:

1. A flush tank mechanism for flushing liquid in a wide variety of flush tanks each of which has a different volume to depth profile defined by internal surfaces thereof, said mechanism comprising:

(a) a frame mountable within the flush tank by connection with a flush exit means for communicating liquids out of the flush tank;

(b) a flush valve mounted in said frame;

(c) a flush valve lifting mechanism interconnected with said flush valve and mounted on said frame above said flush valve for lifting same;

(d) a weir mounted on said frame surrounding said valve and extending above said valve to a predetermined height, said weir being spaced apart on all sides from the internal surfaces of the flush tank when said frame is mounted within the flush tank; and (e) means for selecting the height of at least a portion of said weir relative to said flush valve to set said predetermined height and thereby set the amount of liquid flushed by said flush tank mechanism, said weir height selection means comprising a plurality of rupturable panels formed on said weir at different levels thereof.

2. A flush tank mechanism as claimed in claim 1 wherein said weir forms part of said frame.

3. A flush tank mechanism as claimed in claim 2 wherein said weir comprises a generally cup-shaped receptacle having an upper rim from which a plurality of supports extend.

4. A flush tank mechanism as claimed in claim 3 wherein said flush valve comprises an upstanding hollow stem, having an upper end which constitutes an overflow arrangement and a lower end which includes a sealing means for sealing said flush exit means, and wherein said cup-shaped receptacle has an opening therein leading to a spigot adapted to be received in a said flush exit means, said opening being closable by said sealing means.

5. A flush tank mechanism as claimed in claim 1, wherein said flush valve lifting mechanism includes means for prematurely ending a flush, thereby providing a reduced volume flush; whereby said weir determines the amount of liquid flushed by said flush tank mechanism in a full volume flush.

6. A method for flushing a predetermined volume of liquid from a flush tank independent of the volume to depth profile of the flush tank defined by internal surfaces of the flush tank, the flush tank having a maximum liquid height, the method comprising the steps of:

(a) installing a flush tank mechanism in the flush tank by connecting the flush tank mechanism to a flush exit means for communicating the liquid out of the flush tank, the flush tank mechanism including:

(1) a frame;

(2) an operator actuated flush valve mounted on the frame;

(3) a flush valve lifting mechanism interconnected with the flush valve and mounted on the frame above the flush valve for lifting same; and (4) a weir mounted to the frame, the weir surrounding the flush valve and being spaced apart on all sides from the interior surfaces of the flush tank, wherein the weir includes a generally cup-shaped receptacle with an upper rim from which a plurality of supports extend, and a plurality of rupturable panels formed in the rim of the receptacle at different levels thereof;

(b) determining a cessation level for the flush tank which provides the predetermined volume of liquid in the flush tank from the cessation level to the maximum liquid height for the flush tank; and (c) selectively removing panels from the weir to provide an effective height for the weir relative to the flush valve such that the weir retains a volume of liquid in the flush tank at a level proximate the determined cessation level.

7. The method of claim 6 wherein the flush valve comprises an upstanding hollow stem, having an upper end which constitutes an overflow arrangement and a lower end which includes a sealing means for sealing the flush exit means, and wherein the cup-shaped receptacle has an opening therein leading to a spigot adapted to be received in the flush exit means, the opening being closable by the sealing means.

8. The method of claim 6, wherein the flush valve lifting mechanism includes means for prematurely ending a flush, thereby providing a reduced volume flush, and wherein said determining and selectively removing steps set the amount of liquid flushed by the flush tank mechanism in a full volume flush.

9. An apparatus comprising:

a) a flush tank including a flush exit means for communicating liquids out of the flush tank, said flush tank having a volume to depth profile defined by internal surfaces thereof; and b) a flush tank mechanism for flushing liquid in said flush tank, said mechanism comprising:

i) a frame mounted within said flush tank by connection with said flush exit means;

ii) a flush valve mounted in said frame;

iii) a flush valve lifting mechanism interconnected with said flush valve and mounted on said frame above said flush valve for lifting same;

iv) a weir mounted on said frame surrounding said valve and extending above said valve to a predetermined height, said weir being spaced apart on all sides from said internal surfaces of said flush tank; and v) means for selecting the height of at least a portion of said weir relative to said flush valve to set said predetermined height and thereby set the amount of liquid flushed by said flush tank mechanism, said weir height selection means comprising a plurality of rupturable panels formed on said weir at different levels thereof.

* * * * *